US005445199A

United States Patent [19]

Jia

[11] Patent Number: 5,445,199

[45] Date of Patent: Aug. 29, 1995

[54] BILLFOLD WITH COIN HOLDER

[76] Inventor: Youke Jia, 320 W. 27th St., Apt. 2F, Chicago, Ill. 60616

[21] Appl. No.: 238,536

[22] Filed: May 5, 1994

[51] Int. Cl.[6] ..... A45C 1/06

[52] U.S. Cl. ..... 150/136; 150/139

[58] Field of Search ..... 150/136, 139; 3/247, 3/253

[56] References Cited

U.S. PATENT DOCUMENTS

| | | | |
|---|---|---|---|
| 1,359,319 | 11/1920 | Brenan | 150/136 |
| 1,671,297 | 5/1928 | L'Enfant | 3/247 X |
| 2,680,461 | 6/1954 | Trovato | 150/136 |
| 2,732,875 | 1/1956 | Martin | 3/247 X |
| 3,297,069 | 1/1967 | Aburto | 150/136 |
| 4,832,372 | 5/1989 | Young | 150/139 X |

FOREIGN PATENT DOCUMENTS

| | | | |
|---|---|---|---|
| 1329706 | 5/1963 | France | 150/136 |

*Primary Examiner*—Allan N. Shoap
*Assistant Examiner*—Christopher J. McDonald
*Attorney, Agent, or Firm*—Juettner Pyle Lloyd & Piontek

[57] ABSTRACT

A billfold comprises an inner membrane and an outer membrane of leather or leather-like material juxtaposed one to the other, where the outer periphery of each of the membranes is defined by a top, bottom and two side edges. The bottom and side edges of each membrane are attached one to the other about their periphery through stitching to create an opening and a pocket adapted to receive paper currency. The opening to the pocket is defined between the open top edges of the members. Additional pockets for receiving therein credit cards, pieces of identification and the like can be provided. A strip of material is stitched to the inner membrane of the billfold so as to provide a row of coin pockets. Each coin pocket is sized and adapted to snugly receive therein a coin for storage and ready removal. The coin pockets each have a closed bottom edge, two closed side edges and an open top edge. The open top edge of each coin pocket is placed adjacent a fold line, thus ensuring convenient insertion of the coin within, and removal of the coin from, a coin pocket. On the open top edge of each coin pocket is located a notch, whereby the coin may be grasped during insertion and removal. When the billfold is folded upon itself, the fold line of the billfold restrains the coin within the coin pocket.

15 Claims, 2 Drawing Sheets

BILLFOLD WITH COIN HOLDER

FIELD OF THE INVENTION

The present invention relates to an improved billfold having an integral coin holder. More particularly, the present invention is directed to a leather billfold wherein a plurality of coin receiving pockets are provided in side by side relation, allowing the billfold to be closed to a minimal thickness.

BACKGROUND OF THE INVENTION

Billfolds used to carry paper currency, credit cards, pieces of identification and other rectangularly shaped items have been in existence for many years. Such billfolds are typically manufactured from leather or leather-like materials and are stitched at appropriate locations to provide one or more pockets into which the foregoing rectangular items to be carried may be inserted. In the most usual configuration, the billfold is designed to be folded one or more times onto itself for compactness of size and for insertion into a clothing pocket or pocketbook.

However, currency also takes the form of coin pieces, or thin circularly shaped cylindrical metal pieces assigned a particular denomination or monetary value. In the United States, such coins includes pennies, nickels, dimes, quarters, half dollars and silver dollars, although the latter two coin pieces are rarely used in common circulation.

The use of coin pieces in today's society is widespread and includes a number of important application to which the present invention may be beneficially directed. These applications include parking meters, toll booths, coin operated vending machines and such other applications where the use of paper currency is often inconvenient or impossible. In such situations, it is often advantageous to maintain a supply of coin pieces on one's person so that the desired or necessary coin pieces may be conveniently accessed.

Billfolds have been designed which, in addition to accepting paper currency for storage and subsequent folding, accept into a "change purse" various coin pieces for later retrieval. Such "change purses" incorporated into billfolds heretofore have taken the form of a common pouch into which all denominations of coin pieces may be placed, the pouch being subsequently zippered or snapped closed to restrain the coin pieces therein. However, a significant drawback to such common pouches is that they typically result in a thickness which is much thicker than the thickness of the folded billfold itself. Thus, the convenience of placing a folded billfold into a clothing pocket can be compromised. Moreover, by placing the coin pieces into a common pouch, the ability to quickly and conveniently retrieve a coin piece of a particular denomination is often made difficult and time consuming. Also, in the case of snap closed pouches, separation of the snap from the cover caused by repeated use over time and the loss of the ability to restrain the coins within the pouch often occurs, with deleterious consequences.

SUMMARY OF THE INVENTION

In accordance with the foregoing drawbacks associated with the change purses and billfolds of the prior art, it is an object of the present invention to provide a billfold capable of conveniently accepting coin pieces for carrying on one's person.

It is a further object of the present invention to provide a billfold capable of accepting such coin pieces while maintaining its ability to be folded over onto itself and to yet maintain a thickness readily insertable into a pocket of clothing.

It is another object of the present invention to provide a billfold capable of allowing ready and convenient access to one or more coin pieces of a particular denomination.

It is still a further object of the present invention to provide a billfold capable of providing durable retention of one or more coin pieces of a particular denomination under repeated use over time.

These and additional objects of the present invention may be determined from a review of the instant disclosure, wherein there is disclosed a billfold which is foldable onto itself along one or more fold lines to create a bi-fold or tri-fold type of billfold for the storage of paper currency, credit cards, identification pieces and the like on one's person, and further allowing the convenient storage and access to one or more coin pieces.

The billfold comprises, in a construction typical of billfolds known here to date, an inner membrane and an outer membrane of leather or leather-like material juxtaposed one to the other, where the outer periphery of each of the membranes is defined by a top, bottom and two side edges. As is customary, the bottom and side edges of each membrane are attached one to the other about the periphery, typically through stitching, to create a pocket adapted to receive paper currency. An opening to the pocket is defined between the open top edges of the members. Additional pockets for receiving therein credit cards, pieces of identification and the like can be provided.

A strip of leather or leather-like material is attached, again preferably by stitching, to the inner membrane of the billfold so as to provide a row of coin pockets. Each coin pocket is sized and adapted to snugly receive therein a coin for storage and ready removal. The coin pockets each have a closed bottom edge, two closed side edges and an open top edge.

As a particularly advantageous feature of the present invention, the open top edge of each coin pocket is placed adjacent a fold line, thus ensuring convenient insertion of the coin within, and removal of the coin from, a coin pocket. Convenience is further promoted by providing the open top edge of each coin pocket with a notch, whereby the coin may be grasped during insertion and removal.

When the billfold is folded upon itself, the fold line of the billfold restrains the coin within the coin pocket. Therefore; closure means are avoided, and the coin pieces carried within the coin pockets are readily accessible. Further, since only a single thickness of coin is carried in each side-by-side coin pocket, the resulting thickness of the filled coin pocket is minimized. Thus, the overall thickness of the folded billfold is substantially unchanged and remains conveniently insertable into a clothing pocket.

Other objects, advantages and features of the invention will become apparent upon a consideration of the following detailed description, when taken in conjunction with the accompanying drawings.

DETAILED DESCRIPTION OF THE INVENTION

Figure 1:
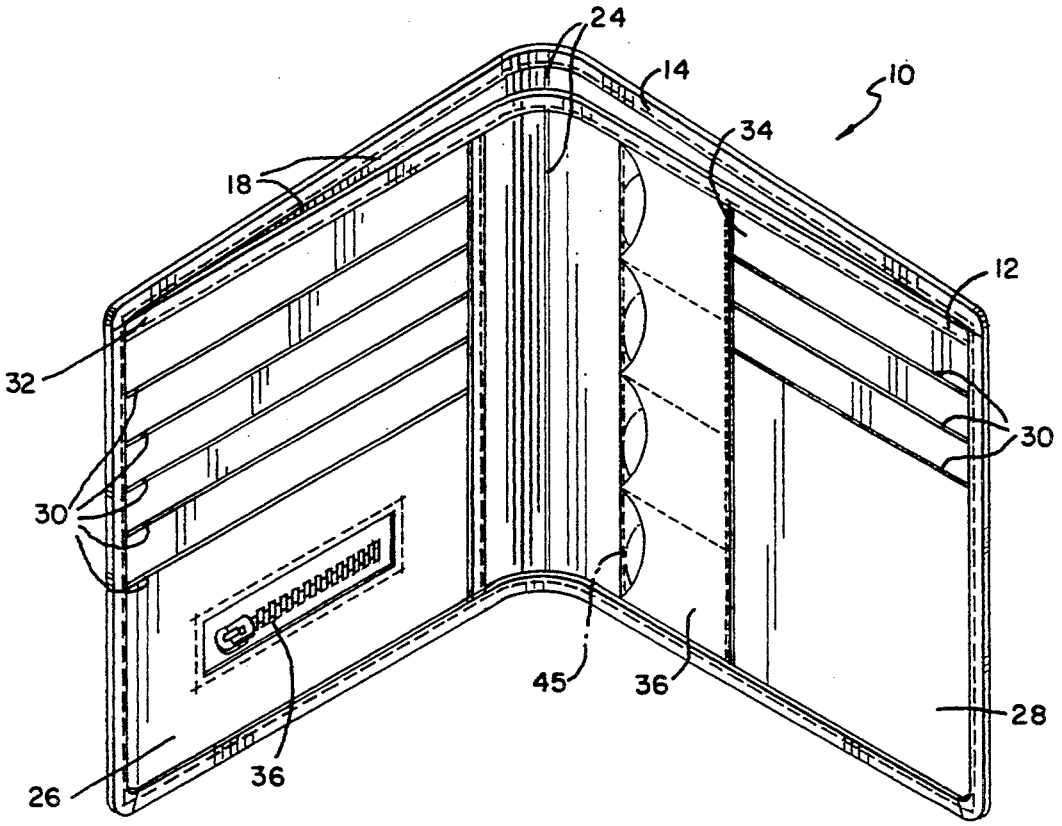
FIG. 1 is a perspective view of a first embodiment of the billfold of the present invention having a single fold line.
Figure 2:
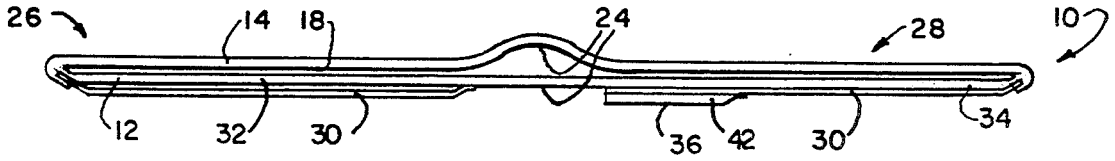
FIG. 2 is a top plan view of the first embodiment of the billfold of the present invention.
Figure 3:
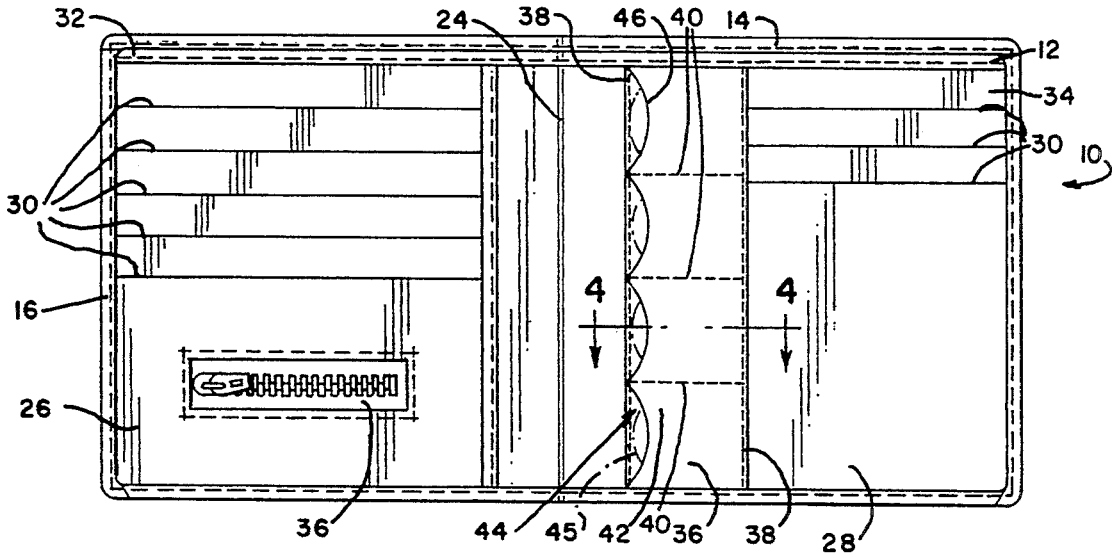
FIG. 3 is a inner plan view of the first embodiment of the billfold of the present invention.
Figure 4:
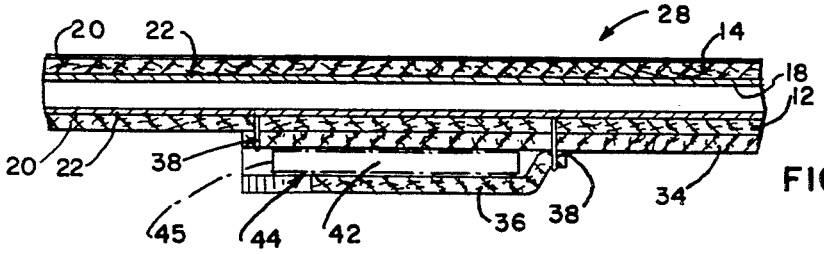
FIG. 4 is a partial cross-sectional view of the first embodiment of the billfold of the present invention taken along the section 4—4 of FIG. 3.

There is illustrated in the accompanying drawings a first embodiment of the billfold which is presently contemplated for carrying out the invention. As shown in FIG. 1, a billfold, indicated generally at 10, is conventionally comprised of an inner membrane 12 and outer membrane 14, preferably manufactured from leather or a leather-like material. As best shown in FIG. 3, the bottom and side edges of the membranes 12, 14 are stitched together in a manner and by methods well known in the art through peripheral stitching 16. The top edges of the membranes 12, 14 remain open, to form a paper currency receiving pocket opening 18, which as shown in FIG. 4 is preferably lined with a silk or other smooth fabric 20 on both interior side surfaces 22 to aid in the insertion and removal of paper currency.

Referring again to FIG. 1, the billfold is characterized by the presence of a fold line 24, which acts as a pivot to allow billfold halves 26 and 28 to be rotated into substantially side by side relation one to the other when the billfold is folded.

As shown in the Figures, billfold 10 can be provided with additional pockets 30 as is known in the art to store for safekeeping on one's person credit cards, personal identification pieces such as driver's licenses and the like. It is further preferable to provide pockets between the inner membrane 12 and facing membranes 32 and 34 for carrying other types of items, such as receipts, tickets and the like, each placed roughly over billfold halves 26, 28. Preferably, the pockets 30 are disposed within the facing membranes 32, 24. Moreover, for items such as keys and the like, zippered pouches 36 can be employed.

In accordance with the present invention, a strip 36 is placed adjacent the fold line 24. As shown in FIG. 3, the strip 36 is preferably likewise held in place by peripheral stitching 38. Additional longitudinal stitching 40 is provided and, in the embodiment shown, along with the peripheral stitching 38, is designed to yield four coin pockets 42, each having a closed bottom edge and two closed side edges. A top edge 44 is left open, whereby into each coin pocket 42 a coin 45 may be inserted for safekeeping and removal as needed. Preferably, a notch 46 is cut out of the strip 36 coincident with the top edge 44 of each coin pocket 42 to allow grasping of the coin 45 by a person for removal and thereby facilitate convenient and ready access to the coins 45.

Moreover, when the billfold halves 26 and 28 are placed into substantially side by side relation one to the other during folding, the fold line 24 of the billfold 10 prevents the coins 45 from accidently coming out of the coin pocket 42, thereby restraining the coins 45 in place until desired or needed.

Figure 5:
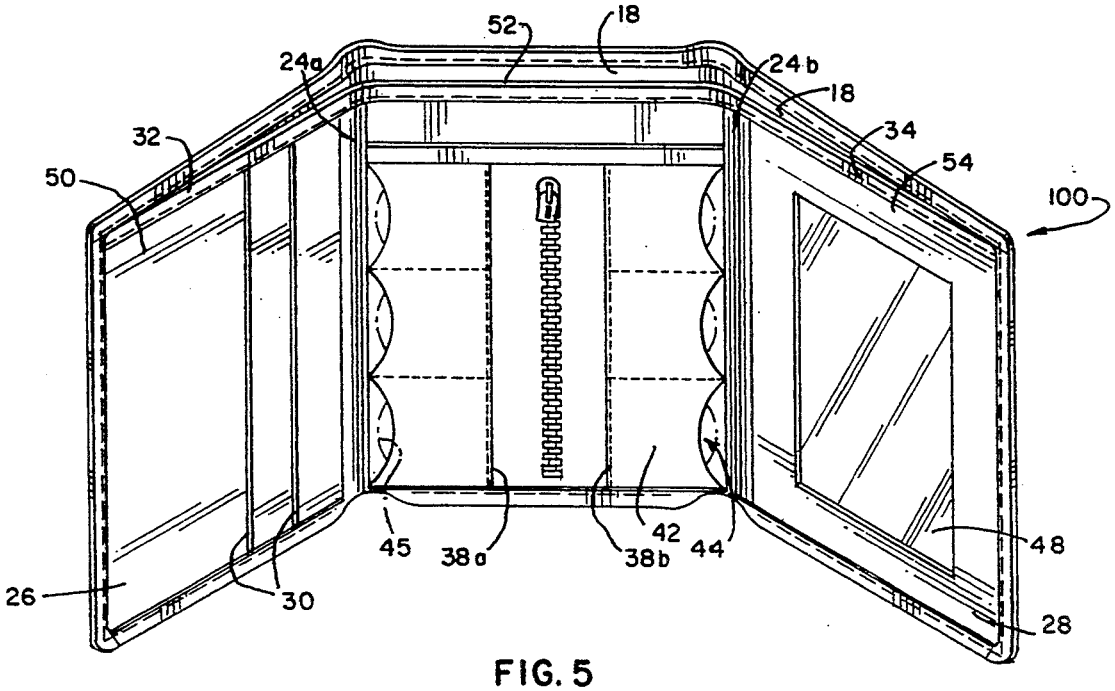
FIG. 5 is a perspective drawing of a second embodiment of the billfold of the present invention having a pair of fold lines.

FIG. 5 shows a second embodiment of a billfold 100 presently contemplated for carrying out the invention. As can be readily observed, similar structures, designated by similar reference characters, are provided as to those shown in FIGS. 1–4 in relation to the first embodiment. Additionally, a picture window 48 can be provided for photographs or identification pieces.

In contrast to the first embodiment, a pair of fold lines **24*a* and 24*b* allow the billfold thirds 50, 52 and 54 to rotate into substantially side by side relation each to the other as folded. A pair of strips 38*a* and 38*b* are each placed adjacent one of the fold lines 24*a*, 24*b* such that the open top edge 44 of each of the coin pockets 42 are located adjacent a fold line. In a manner similar to that of the first embodiment, the fold lines 24*a* and 24*b* of the billfold 100 prevents the coins 45 from accidently coming out of the coin pocket 42, thereby restraining the coins 45** in place until desired or needed.

While embodiments of the invention have been described in detail, various modifications and other embodiments thereof may be devised by one skilled in the art without departing from the spirit and scope of the invention, as defined by the appended claims.

I claim:

1. In combination with a billfold of the type having a plurality of item-receiving pockets therein adapted to receive paper currency, credit cards, identification pieces and the like, the billfold having a fold line and being foldable upon itself along the fold line, the billfold having an inner membrane and an outer membrane juxtaposed one to the other, each of the membranes having a periphery defining a top, bottom and two side edges, the bottom and side edges of each membrane being attached one to the other about the periphery thereof, an .opening to a one of the item-receiving pockets adapted to receive paper currency being defined between the top edges of the members, a single layer strip of material having a bottom and two side edges, the single layer strip being attached in fixed parallel juxtaposition by the bottom and side edges of the single layer strip to the billfold inner membrane so as to substantially define a plurality of coin pockets in side by side relation, each of the plurality of coin pockets adapted to snugly receive therein a single coin only, each of the coin pockets having a closed bottom edge, two closed side edges and an open top edge, each of the coin pocket bottom and side edges being attached to the inner membrane such that the open top edge of each of the plurality of coin pockets is adjacent the fold line for insertion of the coin within and removal of the coin from one of the plurality of coin pockets, and such that when the billfold is folded upon itself, the coin within the one of the plurality of coin pockets is restrained within the one of the plurality of coin pockets.

2. The combination of claim 1, wherein the Single layer strip of material is attached to the inner membrane through a stitching pattern, the stitching pattern substantially defining the closed bottom edge and two closed side edges of the plurality of coin pockets.

3. The combination of claim 1, wherein the Single layer strip of material is provided with a plurality of notches, such that a notch is positioned at the open top edge of each of the plurality of coin pockets, whereby the coin may be grasped during insertion and removal.

4. The combination of claim 1, wherein the billfold is foldable onto itself along two fold lines and a pair of single layer strips of material are attached to the billfold to substantially define two rows of a plurality of coin pockets, the open top edge of each of the two rows of the plurality of coin pockets being placed adjacent a One of the fold lines for convenient insertion of the coin within and removal of the coin from the one of the plurality of the coin pockets.

5. The combination of claim 1, wherein the membranes and single layer strip of material are of leather-like material.

6. A billfold having a fold line and foldable onto itself along the fold line for storing paper currency and coins, the billfold comprising:

an inner membrane and an outer membrane juxtaposed one to the other, each of the membranes having a top, bottom and two side edges, the bottom and side edges of each membrane being attached one to the other about a periphery thereof to create thereby an item-receiving pocket adapted to receive paper currency, an opening to the item-receiving pocket being defined between the top edges of the members, a single layer strip of material having a bottom and two side edges, the single layer strip being attached in fixed parallel juxtaposition by the bottom and side edges of the single layer strip to the inner membrane of the billfold substantially defining thereon a plurality of coin pockets, each of the plurality of coin pockets adapted to snugly receive therein a single coin only, each of the plurality of coin pockets having a closed bottom edge, two closed side edges and an open top edge, each open top of the plurality of each coin pockets being placed adjacent the fold line for insertion of the coin within and removal of the coin from a one of the plurality of the coin pockets, and the single layer strip of material being attached to the inner membrane such that when the billfold is folded upon itself, the coin within the one of the plurality of coin pockets is restrained within the one of the plurality of coin pockets.

7. The invention of claim 6, wherein the single layer strip of material is attached to the inner membrane through a stitching pattern, the stitching pattern substantially defining the closed bottom edge and two closed side edges of each of the plurality of the coin pockets.

8. The invention of claim 6, wherein the single layer strip of material is provided with a plurality of notches, such that a notch is positioned at the open top edge of each of the plurality of coin pockets, whereby the coin may be grasped during insertion and removal.

9. The invention of claim 6, wherein the billfold is foldable onto itself along two fold lines and a pair of single layer strips of material are attached to the billfold to substantially define two rows of a plurality of coin pockets, the open top edge of each of the plurality of coin pockets being placed adjacent a one of the fold lines for convenient insertion of the coin within and removal of the coin from the one of the plurality of coin pockets.

10. The invention of claim 6, wherein the membranes and single layer strip of material are of leather-like material.

11. A bill having a fold line and being foldable onto itself along the fold line, the billfold comprising:

an inner billfold surface and an outer billfold surface, a single layer strip of material having a bottom and two side edges, the single layer strip being attached in fixed parallel juxtaposition by the bottom and side edges of the single layer strip to the inner billfold surface of the billfold substantially defining thereon a plurality of coin pockets, each of the plurality of coin pockets adapted to snugly receive therein a single coin only, each of the plurality of coin pockets having a closed bottom edge, two closed side edges and an open top edge, each open top of the plurality of each coin pockets being placed adjacent the fold line for insertion of the coin within and removal of the coin from a one of the plurality of the coin pockets, the single layer strip of material being attached to the inner billfold surface such that when the billfold is folded upon itself, the coin within the one of the plurality of coin pockets is restrained within the one of the plurality of coin pockets,

12. The invention of claim 11, wherein the single layer strip of material is attached to the inner billfold surface through a stitching pattern, the stitching pattern substantially defining the closed bottom edge and two closed side edges of each of the plurality of the coin pockets.

13. The invention of claim 11, wherein the single layer strip of material is provided with a plurality of notches, such that a notch is positioned at the open top edge of each of the plurality of coin pockets, whereby the coin may be grasped during insertion and removal.

14. The invention of claim 11, wherein the billfold is foldable onto itself along two fold lines and a pair of single layer strips of material are attached to the inner billfold surface to substantially define two rows of a plurality of coin pockets, the open top edge of each of the plurality of coin pockets being placed adjacent a one of the fold lines for convenient insertion of the coin within and removal of the coin from the one of the plurality of coin pockets.

15. The invention of claim 11, whereby the billfold surfaces and the single layer of material are of leather-like material.

* * * * *